US007220163B2

(12) United States Patent
Shin

(10) Patent No.: US 7,220,163 B2
(45) Date of Patent: May 22, 2007

(54) METHOD AND APPARATUS FOR MEASURING ABRASION AMOUNT AND PAD FRICTION FORCE OF POLISHING PAD USING THICKNESS CHANGE OF SLURRY FILM

(75) Inventor: Sung-Ho Shin, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/428,813

(22) Filed: Jul. 5, 2006

(65) Prior Publication Data

US 2007/0015442 A1 Jan. 18, 2007

(30) Foreign Application Priority Data

Jul. 15, 2005 (KR) ..... 10-2005-0064181

(51) Int. Cl.
*B24B 49/00* (2006.01)

(52) U.S. Cl. ..... 451/8; 451/10; 451/11; 451/21; 451/36; 451/56

(58) Field of Classification Search ..... 451/5, 451/8, 9, 10, 11, 21, 36, 56, 41, 443
See application file for complete search history.

(56) References Cited

U.S. PATENT DOCUMENTS 5,743,784 A 4/1998 Birang et al.

(Continued)

FOREIGN PATENT DOCUMENTS

JP 2002-052459 2/2002

(Continued)

OTHER PUBLICATIONS

English language abstract of Japanese Publication No. 2002-353174.

(Continued)

*Primary Examiner*—Eileen P. Morgan
(74) *Attorney, Agent, or Firm*—Marger Johnson & McCollom, P.C.

(57) ABSTRACT

A method and apparatus for measuring an abrasion amount and a friction force of a polishing pad using a thickness change of a slurry film in a chemical mechanical polishing operation are provided. In a preferred method, for example, a first displacement of a semiconductor wafer with respect to a polishing pad is measured during an initial stage and a first reference range of the thickness change of the slurry film is preferably set to determine a replacement time corresponding to the abrasion amount of the polishing pad. A conditioning condition of the polishing pad conditioning can also be set, and a second displacement of the semiconductor wafer with respect to the polishing pad can be measured when the surface of the semiconductor wafer is polished by the polishing pad. The first displacement is then preferably compared with the second displacement to calculate the thickness change of the slurry film formed between the polishing pad and the semiconductor wafer. When the thickness change of the slurry film is out of the first reference range, the polishing pad is preferably replaced. When the surface state of the polishing pad corresponding to the thickness change of the slurry film fails the conditioning condition, a conditioning operation to condition the surface of the polishing pad is preferably performed.

16 Claims, 10 Drawing Sheets

U.S. PATENT DOCUMENTS

| | | | | |
|---|---|---|---|---|
| 5,934,974 | A | 8/1999 | Tzeng | |
| 6,045,434 | A | 4/2000 | Fisher, Jr. et al. | |
| 6,273,792 | B1 * | 8/2001 | Meloni | 451/41 |
| 6,458,013 | B1 * | 10/2002 | Saka et al. | 451/5 |
| 7,147,541 | B2 * | 12/2006 | Nagayama et al. | 451/5 |
| 2003/0060127 | A1 | 3/2003 | Kaushal et al. | |

FOREIGN PATENT DOCUMENTS

| | | |
|---|---|---|
| JP | 2002-353174 | 12/2002 |
| JP | 2003-311615 | 11/2003 |

OTHER PUBLICATIONS

English language abstract of Japanese Publication No. 2002-052459.

English language abstract of Japanese Publication No. 2003-311615.

* cited by examiner

METHOD AND APPARATUS FOR MEASURING ABRASION AMOUNT AND PAD FRICTION FORCE OF POLISHING PAD USING THICKNESS CHANGE OF SLURRY FILM

CROSS-REFERENCE TO RELATED PATENT APPLICATION

This application claims the benefit of Korean Patent Application No. 10-2005-0064181, filed on Jul. 15, 2005, in the Korean Intellectual Property Office, the disclosure of which is incorporated herein in its entirety by reference.

BACKGROUND OF THE INVENTION

1. Field of the Invention

The present invention relates to a semiconductor wafer process, and more particularly, to a chemical mechanical polishing (CMP) method and apparatus for measuring an abrasion amount and friction force of a polishing pad using the thickness change of a slurry film in a CMP process.

2. Description of the Related Art

To manufacture a semiconductor device, various layers are deposited on a surface of a semiconductor wafer and patterned to form a circuit. In this stacking structure, wiring layers formed on different layers are connected to each other through vias and contact nodes. An intermediate layer is formed on the top surface of a lower wiring layer and planarized to expose the lower wiring layer. Then, an upper wiring layer is formed on the intermediate layer, thereby forming a stacked structure of wiring layers. A CMP process is generally performed to planarize the lower layer.

The CMP process is performed by a polisher. The polisher presses a contact surface of a polishing pad onto a contact surface of a semiconductor wafer to be polished. The polisher further supplies abrasive slurry in the space between the semiconductor wafer and the polishing pad and generates a mechanical motion of the polishing pad relative to the semiconductor wafer. The motion of the polishing pad relative to the semiconductor wafer can be generated using a belt type linear motion so that the polishing pad moves linearly, or a disk type rotational motion so that the relative motion is circular. In the CMP process, since the contact surface of the polishing pad is pressed on the contact surface of, and moves relative to the semiconductor wafer, a friction force is generated between the contact surfaces of the pad and the semiconductor wafer. The abrasive slurry supplied onto the contact surfaces thereby effectively removes the layer of the semiconductor wafer. The polishing pad should have a proper surface roughness such that a desired friction force can be generated as the polishing pad rubs the semiconductor wafer. The slurry should also be properly supplied into the space between the polishing pad and the semiconductor wafer. Since the surface condition of the polishing pad affects the polishing rate and polishing uniformity of the layer removed from the semiconductor wafer, the surface roughness should be maintained within an acceptable predetermined range.

To maintain the surface roughness of the polishing pad, a pad conditioning operation can be performed. In the pad conditioning operation, the contact surface of the polishing pad is continuously or intermittently mechanically rubbed either during the CMP process or after the CMP process. Unfortunately, although the pad conditioning operation helps maintain the surface roughness of the polishing pad in an acceptable range, the operation reduces the thickness of the polishing pad, and decreases the lifetime of the polishing pad. As the polishing pad is rubbed, the depths of grooves formed in the polishing pad decrease. When the depths of the grooves in the polishing pad are less than a predetermined value a proper amount of slurry cannot be supplied into the groove. Accordingly, under a predetermined pressure, the average thickness of a slurry film formed between the polishing pad and the semiconductor wafer changes. This thickness change of the slurry film reduces the pressure and the friction force between the contact surface of the polishing pad and the semiconductor wafer, thereby reducing the ability to remove the layer in the polishing operation.

Accordingly, since the polishing ability decreases due to the thickness decrease of the polishing pad, the polishing pad should be replaced when the thickness of the polishing pad is less than a predetermined acceptable value. In a conventional CMP process, the replacement time of the polishing pad is determined based on the accumulated use time of the polishing pad using a predetermined safety standard for managing the distribution of the CMP process. However, replacing the polishing pad based on the predetermined safety regulation does not provide an effective way of determining when to replace the polishing pad.

Various methods of optimally determining the replacement time of the polishing pad have been suggested. U.S. Pat. No. 5,934,974 discloses a non-contact method in which a laser sensor is used to directly measure a distance from the laser sensor to a surface of a polishing pad to calculate an abrasion amount of the polishing pad. In addition, U.S. Pat. No. 6,045,434 discloses a method in which an abrasion amount and abrasion profile of a polishing pad are monitored using ultrasonic or electromagnetic radiation transmitters arranged at a predetermined distance from the surface of the polishing pad to directly measure a distance to the surface of the polishing pad. However, in these methods, it is difficult to directly measure the distance between the semiconductor wafer and the polishing pad in a polishing operation because the polishing pad is always wet with water and slurry.

U.S. Pat. No. 5,743,784 discloses a method in which an abrasion state of the surface of a polishing pad is monitored in a conditioning operation, thereby determining an end point of the conditioning operation for the polishing pad. In this method, a disk type head is fixed on the surface of a polishing pad, and a friction force between the disk type head and the polishing pad is measured using a load cell. This determines the end point of the conditioning operation for the polishing pad. Unfortunately, however, the friction force between the disk type head and the polishing pad is significantly dependent on the conditioning degree of the polishing pad. Thus, this method is not suitable to monitor the abrasion or wear state of a polishing pad to determine its remaining useful life.

SUMMARY OF THE INVENTION

The present invention provides a method and apparatus for determining an abrasion state of a polishing pad by detecting a thickness change of a slurry film.

The present invention also provides a method and apparatus for measuring a friction force of a polishing pad by monitoring a thickness change of a slurry film, which relates to the surface roughness of the polishing pad, to optimize a conditioning amount of the polishing pad.

According to one aspect of the present invention, a method of measuring an abrasion amount of a polishing pad preferably proceeds by measuring a first displacement of a semiconductor wafer with respect to the polishing pad in an initial stage. A reference range for a thickness change of the slurry film is preferably set and a second displacement of the semiconductor wafer with respect to the polishing pad is measured during a polishing operation. The first displacement is then compared with the second displacement to calculate the thickness change of the slurry film. The polishing pad is preferably replaced when the thickness change of the slurry film is out of the reference range.

According to another aspect of the present invention, a method of adjusting an amount of slurry in a chemical mechanical polishing (CMP) process can be provided. The method preferably includes measuring a first displacement of a semiconductor wafer with respect to a polishing pad in an initial stage. A reference range for a thickness change of the slurry film is set. A second displacement of the semiconductor wafer with respect to the polishing pad is measured during a polishing operation and the first displacement is compared with the second displacement to calculate the thickness change of the slurry film. The amount of the slurry supplied onto the polishing pad is adjusted when the thickness change of the slurry film is out of the reference range.

According to still another aspect of the present invention, a method of measuring a friction force of a polishing pad is provided. The method includes measuring a first displacement of a semiconductor wafer with respect to the polishing pad during an initial stage and setting a conditioning condition of the polishing pad. A second displacement of the semiconductor wafer with respect to the polishing pad is measured during a polishing operation. The first displacement is compared with the second displacement to calculate the thickness change of the slurry film, and a surface of the polishing pad is preferably conditioned when the surface state of the polishing pad does not satisfy the conditioning condition.

The conditioning condition may be changed depending on the thickness change of the slurry film. A polishing operation may be performed following the conditioning operation.

In addition, the rotation speed of the conditioning head and the force applied to the conditioning head may be real time-controlled, thus minimizing the abrasion amount of the polishing pad and optimizing the conditioning operation. The conditioning is preferably stopped when the conditioning condition of the surface of the polishing pad corresponding to the thickness change of the slurry film is satisfied.

The polishing pad preferably moves relative to the semiconductor wafer and/or vice versa. The thickness of the slurry film formed between the polishing pad and the semiconductor wafer is preferably substantially constant during the initial stage and changes in the polishing operation.

According to yet another aspect of the present invention, a semiconductor wafer polishing apparatus preferably includes a polishing pad supported by a platen. A contact surface of the polishing pad faces a surface of a semiconductor wafer and includes grooves of a predetermined depth. A semiconductor wafer carrier supports and moves the semiconductor wafer. A slurry film thickness measuring unit preferably measures a thickness change of a slurry film formed between the semiconductor wafer and the polishing pad. A conditioning device preferably polishes the polishing pad to provide surface roughness thereto. And a control unit preferably controls the slurry film thickness measuring unit, the conditioning device, and the polishing pad in response to the thickness change of the slurry film.

The control unit may include a signal analyzing unit which receives an output signal from the slurry film thickness measuring unit and analyzes the displacement of the semiconductor wafer with respect to the polishing pad. A first monitoring unit can be provided to monitor an output signal from the signal analyzing unit to generate a first signal for conditioning the polishing pad. A second monitoring unit can be provided to monitor the output signal from the signal analyzing unit to generate a second signal for replacing the polishing pad and a third signal for controlling an amount of the slurry supplied onto the polishing pad. A display preferably displays a message indicating a time for replacement of the polishing pad. And a controller preferably receives the first signal from the first monitoring unit, outputs a first control signal to control the conditioning device, receives a second signal from the second monitoring unit, outputs a second control signal to control the polishing pad, a third control signal to control the display, and outputs a fourth control signal to control a slurry container.

BRIEF DESCRIPTION OF THE DRAWINGS

The above and other features and advantages of the present invention will become more readily apparent through the following detailed description of exemplary embodiments thereof, made with reference to the attached drawings in which.

DETAILED DESCRIPTION OF THE INVENTION

Figure 1:
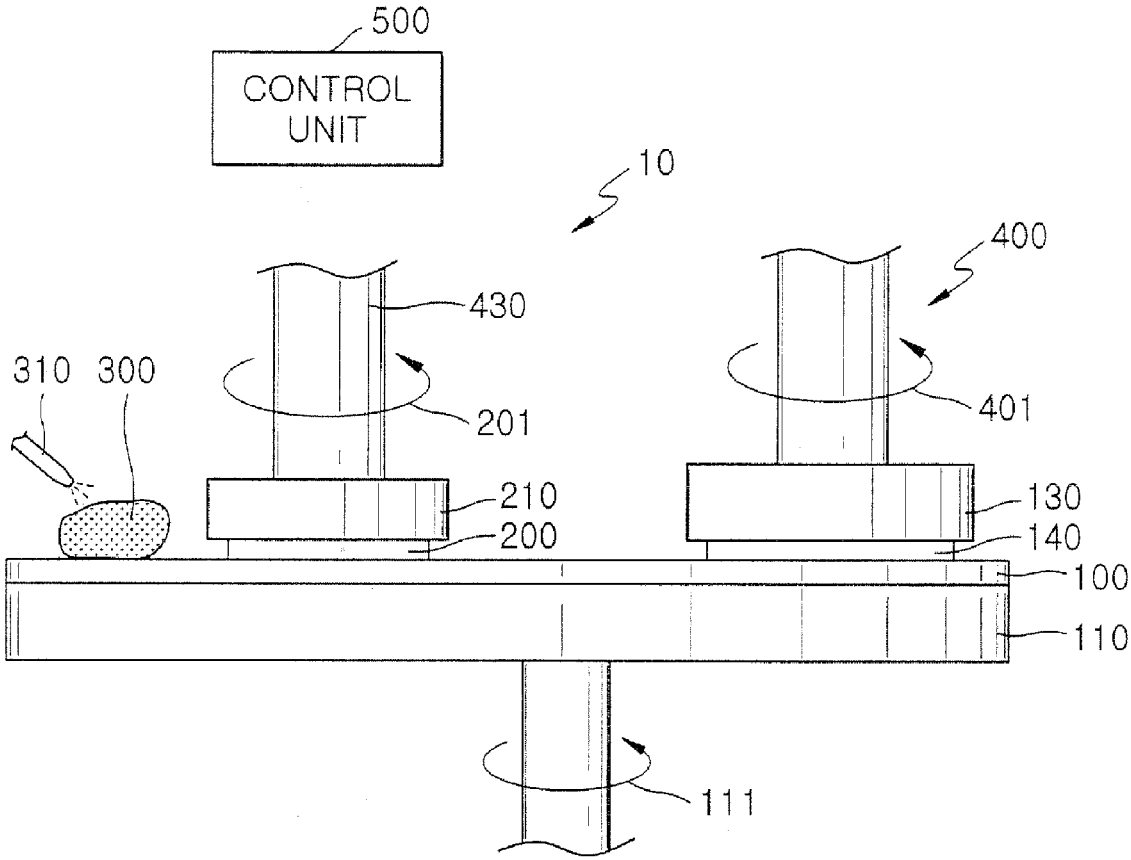
FIG. 1 is a somewhat schematic side elevation view of a polisher according to an embodiment of the present invention.

Hereinafter, various principles of the present invention will be described more fully with reference to the accompanying drawings, in which exemplary embodiments of the invention are shown. As will be apparent to those skilled in the art, the invention may be embodied in many different forms and should not be construed as being limited to the embodiments set forth herein. Rather, these embodiments are provided so that this disclosure will be thorough and complete, and will fully convey the concepts and principles of the invention to those skilled in the art. In the drawings, like reference numerals denote like elements, and the sizes and thicknesses of layers and regions may be exaggerated for clarity.

FIG. 1 is a somewhat schematic side elevation view of a polisher 10 according to an embodiment of the present invention. Referring to FIG. 1, the polisher 10 preferably includes a platen 110 and a polishing pad 100 arranged on the platen 110. The platen 110 and the polishing pad 100 are configured to rotate together about a center axis 111. The polisher 10 further preferably includes a conditioning device 400 for polishing the surface of the polishing pad 100. A slurry film thickness measuring unit 430 is preferably configured and arranged to measure the thickness of a slurry film formed of a chemical mechanical polishing (CMP) slurry 300 between the surface of the polishing pad 100 and the surface of a semiconductor wafer 200.

The conditioning device 400 preferably includes a conditioning head 130 arranged proximal to the platen 110, which rotates about a center axis 401. A diamond abrasive layer 140 is preferably arranged on the surface of the conditioning head 130 to contact the polishing pad 100 and provide roughness to the conditioning head 130. The abrasive layer 140 on the conditioning head 130 can be moved into contact with the surface of the polishing pad 100 by a transporting unit (not illustrated). Although in the current embodiment the conditioning device 400 includes the conditioning head 130 to provide the roughness to the surface of the polishing pad 100, the present invention is not limited to this embodiment, and other conditioning devices such as a conditioning disk or other conditioning devices can be employed.

Figure 2A:
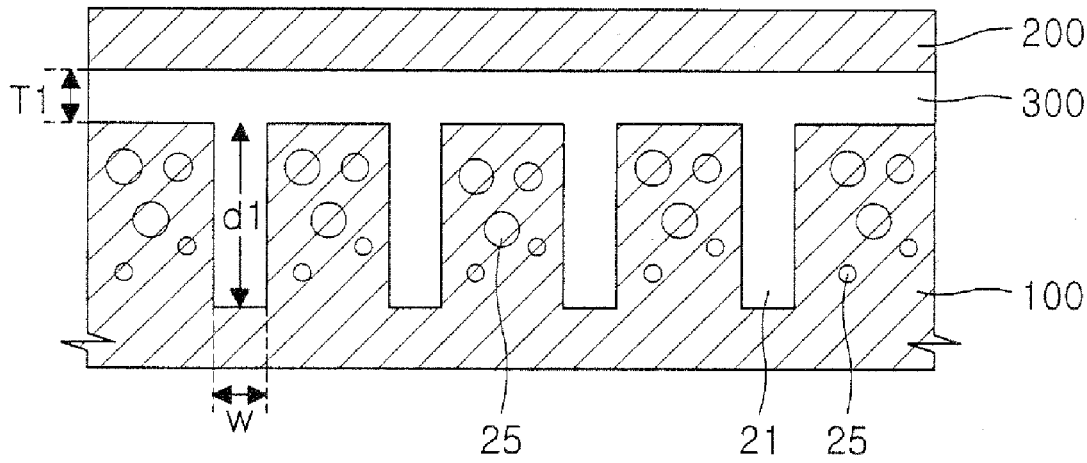
FIGS. 2A and 2B are somewhat schematic cross-sectional views of a polishing pad of the polisher of FIG. 1.
Figure 2B:
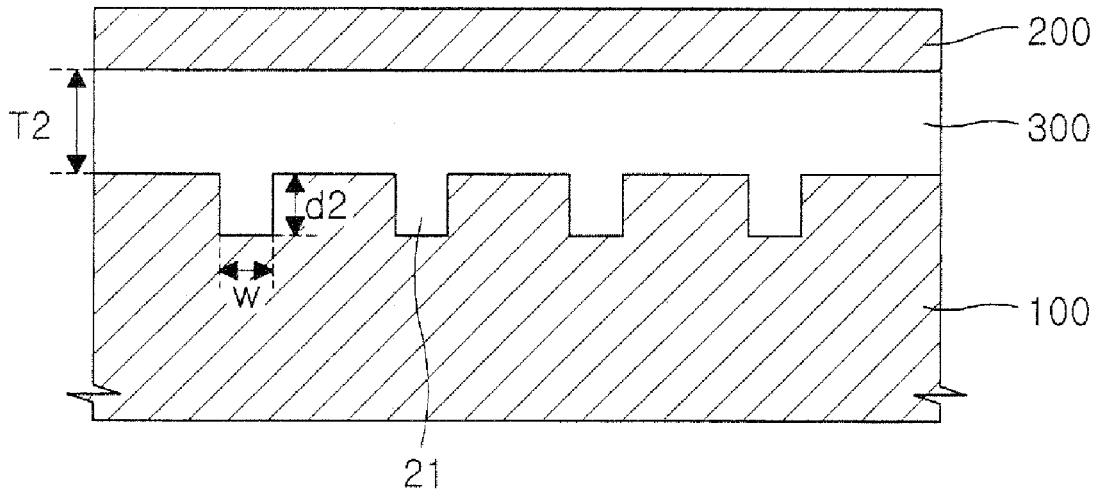

FIGS. 2A and 2B are somewhat schematic cross-sectional side views of the polishing pad 100 arranged in the polisher 10 of FIG. 1. Referring to FIGS. 2A and 2B, grooves 21 having a predetermined width "w" and a predetermined depth "d1" are preferably formed in the surface of the polishing pad 100. When the CMP slurry 300 is injected from a slurry container 310 onto the polishing pad 100, the CMP slurry 300 is disposed between the surface of the semiconductor wafer 200 being polished and the surface of the polishing pad 100. The slurry film preferably has a substantially uniform thickness T1 during a polishing operation. Relative movement between the polishing pad 100 and the semiconductor wafer 200 is generated by moving one or both of the pad 100 and wafer 200 relative to each other. When the relative speed between the polishing pad 100 and the semiconductor wafer 200 (hereinafter, referred to as a relative speed) and the pressure between the semiconductor wafer 200 and the polishing pad 100 are constant, the slurry film has an approximately uniform thickness T1.

Referring to FIG. 2B, as the surface of the polishing pad 100 wears, the depth d1 of the grooves 21 decreases. For example, assuming a substantially uniform relative speed and pressure between the wafer and pad, when the depth "d1" of the grooves 21 decreases to the depth "d2", the thickness of the slurry film increases from "T1" to "T2" because of the tendency to maintain a constant flow rate of the CMP slurry 300. The thickness "T" of the slurry film therefore depends on the depth "d" of the grooves 21, as further illustrated in FIG. 3.

Figure 3:
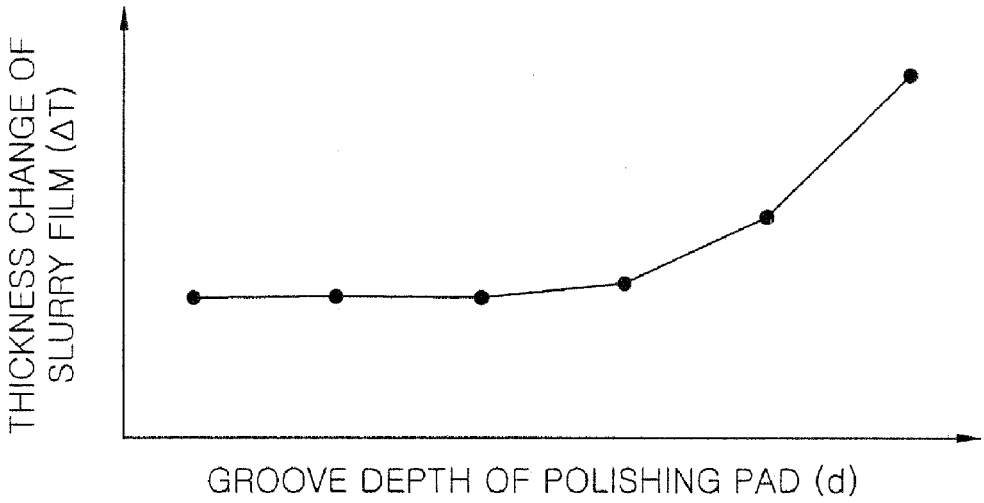
FIG. 3 is a graph illustrating a thickness change of a slurry film versus a groove depth of a polishing pad when a CMP process is performed, according to an aspect of the present invention.

FIG. 3 is a graph illustrating a thickness change "ΔT" of a slurry film versus the groove depth of the polishing pad 100 when a CMP process is performed, according to another aspect of the present invention. Referring to FIG. 3, as the depth "d" decrease (from left to right), the thickness change "ΔT" increases (from bottom to top). As shown in FIG. 3, therefore the thickness change "ΔT" increases as the depth "d" of the grooves 21 decreases.

Figure 6:
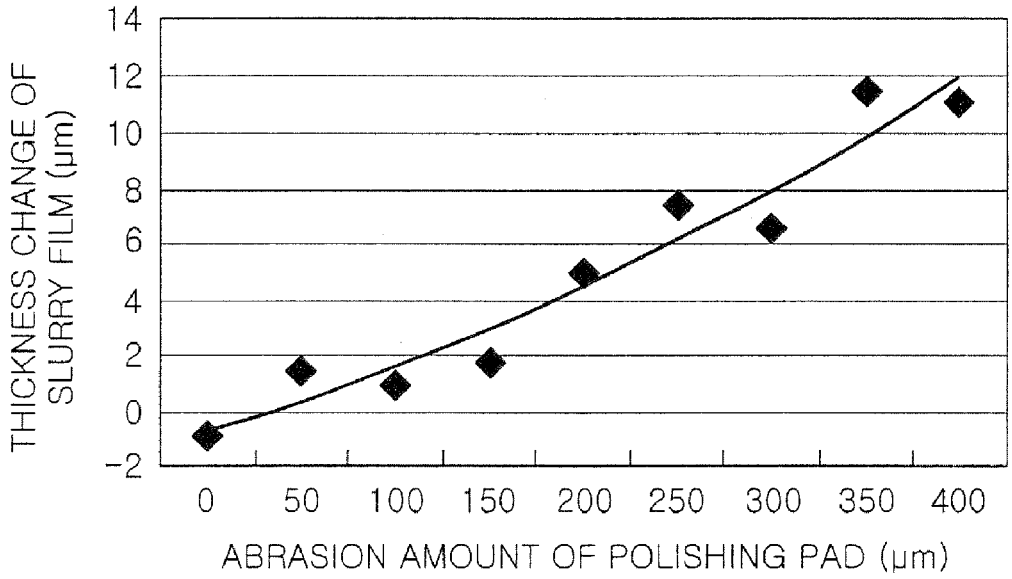
FIG. 6 is a graph illustrating a thickness change of a slurry film versus an abrasion amount of a polishing pad when a CMP process is performed, according to a still further aspect of the present invention.

Similarly, FIG. 6 is a graph illustrating a thickness change "ΔT" of the slurry film versus an abrasion amount of the polishing pad 100 during a CMP process, according to another aspect of the present invention. Referring to FIG. 6, the thickness change "ΔT" increases as the abrasion amount of the polishing pad 100 increases. Accordingly, as the polishing pad 100 is worn, the depths "d" of the grooves 21 decreases, an abrasion amount increases, and the thickness "T" of the slurry film increases.

Figure 4:
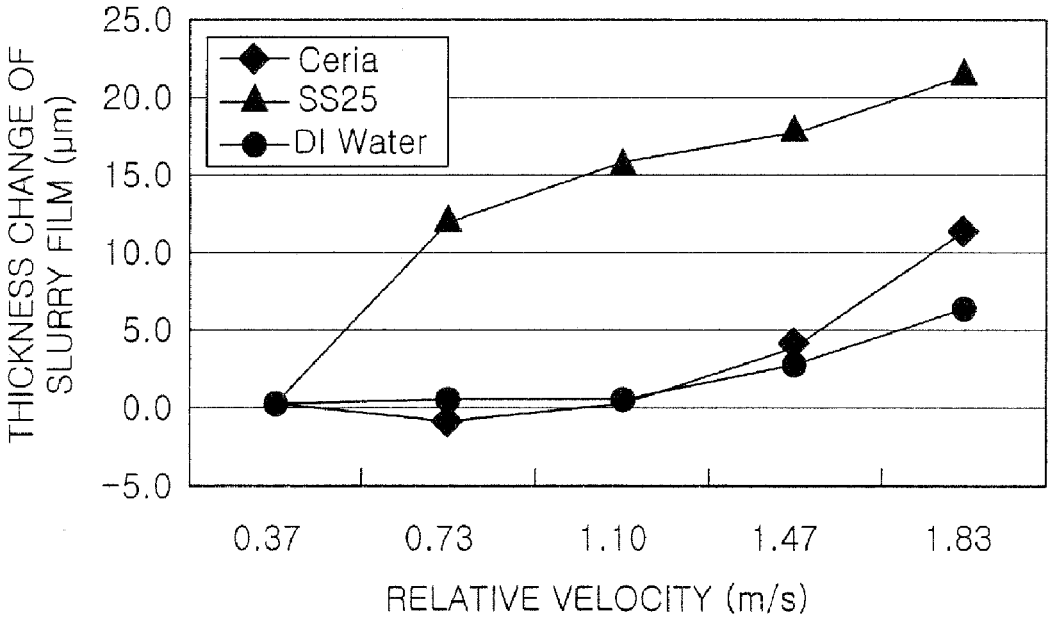
FIG. 4 is a graph illustrating a thickness change of a slurry film versus a relative velocity when a CMP process is performed, according to another aspect of the present invention.

FIG. 4 is a graph illustrating a thickness change "ΔT" of a slurry film versus a relative velocity during a CMP process, according to a still further aspect of the present invention. Referring to FIG. 4, the thickness change "ΔT" of the slurry film increases as the relative speed increases. The thickness "T" also depends on the viscosity of the slurry 300.

Figure 5:
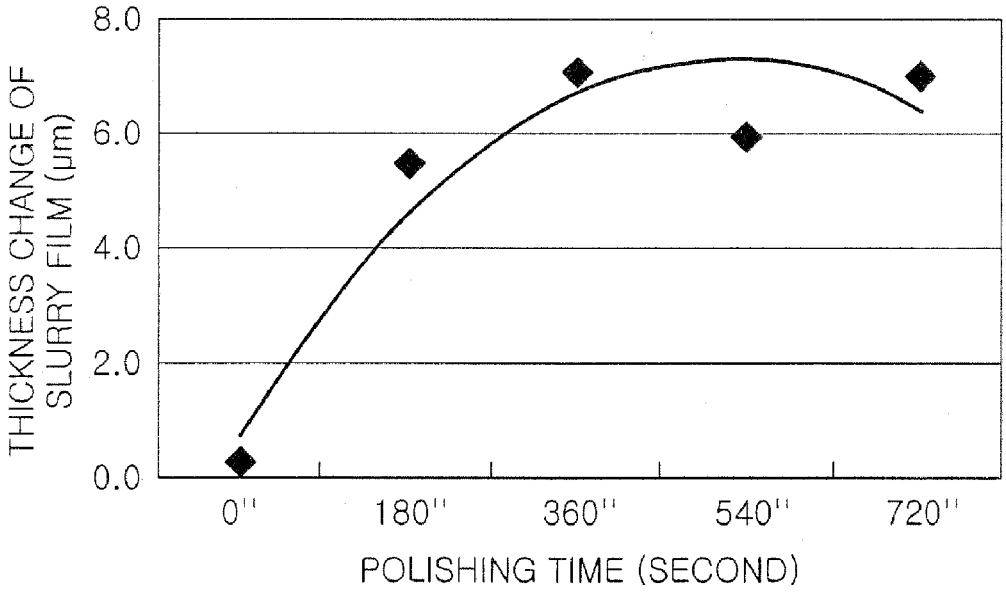
FIG. 5 is a graph illustrating a thickness change of a slurry film versus a polishing time when a CMP process is performed, according to yet another aspect of the present invention.

FIG. 5 is a graph illustrating a thickness change "ΔT" of a slurry film versus a polishing time for the polishing pad 100 during a CMP process, according to another aspect of the present invention. In FIG. 5, as the surface of the semiconductor wafer 200 was chemically mechanically polished using the polishing pad 100 without performing a conditioning operation, the thickness "T" of the slurry film was measured at every 180 seconds from the beginning of the operation. As shown in FIG. 5, the thickness "T" increased as the polishing time increased until a certain polishing time was reached. That is, as the polishing time of the polishing pad 100 increases, up to a certain point, the depth "d" of the grooves 21 decreases and the thickness change "ΔT" of the slurry film therefore increases.

The polishing pad 100 preferably has an appropriate surface roughness sufficient to generate the required friction force when rubbing the semiconductor wafer 200. The surface roughness of the polishing pad may, for example, be approximately 10 μm. The grooves 21 in the polishing pad 100 also preferably properly provide the CMP slurry 300 into the space between the polishing pad 100 and the semiconductor wafer 200. Each of the grooves 21 preferably has a maximum depth of around 500 μm. In addition, the polishing pad 100 preferably includes pores 25. The pores 25 provide a surface roughness to the polishing pad 100 when the surface of the polishing pad is polished during a conditioning operation. Each of the pores 25 preferably has a size of approximately 80 μm.

Figure 7:
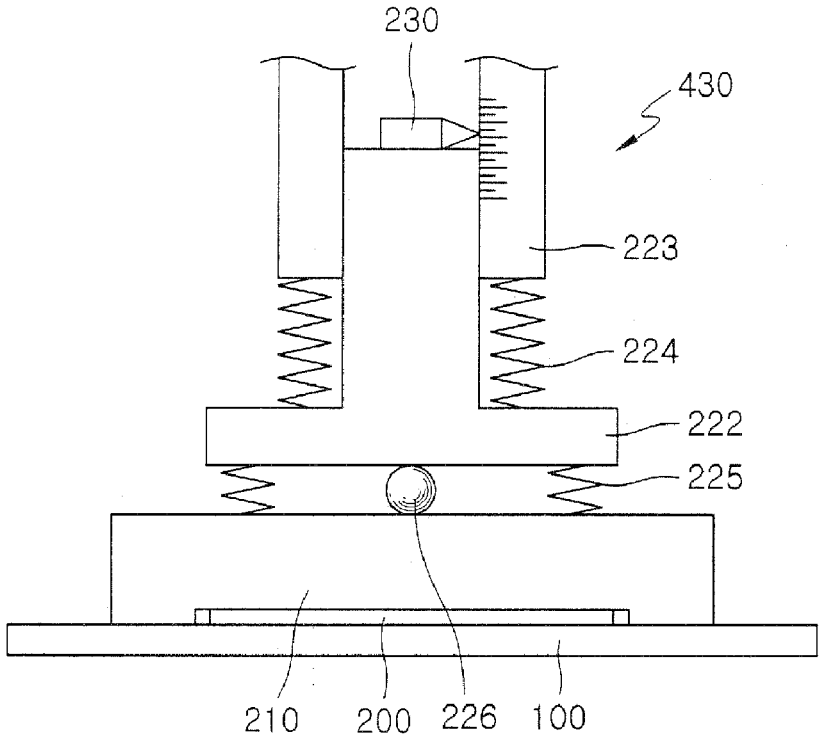
FIG. 7 is a somewhat schematic side elevation view of a slurry film thickness measuring unit, according to an embodiment of the present invention.

FIG. 7 is a somewhat schematic side elevation view of the slurry film thickness measuring unit 430, according to another embodiment of the present invention. Referring to FIG. 7, the slurry film thickness measuring unit 430 preferably includes a semiconductor wafer carrier 210 to hold and move the semiconductor wafer 200. An upper column 222 preferably transmits a downward pressure onto and inputs a rotational motion to the semiconductor wafer carrier 210. The slurry film thickness measuring unit 430 further preferably includes a spring 225 and a rotation axis 226 to maintain the upper column 222 and the semiconductor wafer carrier 210 substantially parallel to each other. The slurry film thickness measuring unit 430 further preferably includes a suspension spring 224 buffering and transmitting a force between the upper column 222 and an upper frame 223. The upper frame 223 can be fixed by an external supporter (not illustrated) and is preferably a reference for the relative motion of the upper column.

In addition, the slurry film thickness measuring unit 430 preferably includes a sensor 230 measuring the thickness change of the slurry film formed between the semiconductor wafer 200 and the polishing pad 100. The sensor 230 can, for example, be a contact type sensor that measures a relative displacement of the upper column 222 with respect to the upper frame 223. The relative displacement preferably indicates the relative moving distance of the upper column 222 with respect to the upper frame 223 corresponding to the thickness change of the slurry film. Also, the relative displacement indicates the displacement of the semiconductor wafer 200 with respect to the polishing pad 100 in a direction perpendicular to the polishing pad 100 and the semiconductor wafer 200. In this embodiment, the sensor 230 is preferably mounted in the upper column 222, but the present invention is not limited to this. For example, the sensor 230 may be mounted in the upper frame 223 or any other appropriate location.

In this embodiment, the relative displacement of the semiconductor wafer 200 with respect to the polishing pad 100 is determined by the displacement of the upper column 222 with respect to the upper frame 223. However, the present invention is not limited to this, and the relative displacement of the semiconductor wafer carrier 210 or the upper column 224 with respect to the upper frame 223 may be determined by the number of rotations of a gear or a bearing. Accordingly, the sensor 230 can for instance, measure a voltage, a resistance, or a distance generated when the upper column 222 is relatively displaced with respect to the upper frame 223, and thus, the thickness change of the slurry film can be determined.

Figure 8:
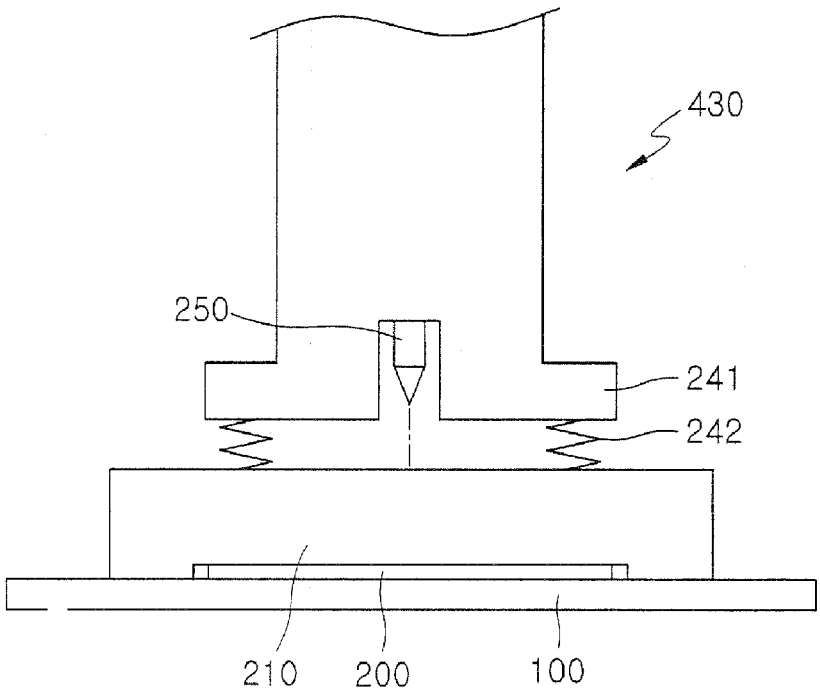
FIG. 8 is a somewhat schematic side elevation view of a slurry film thickness measuring unit, according to another embodiment of the present invention.

FIG. 8 is a somewhat schematic side elevation view of the slurry film thickness measuring unit 430, according to another embodiment of the present invention. Referring to FIG. 8, the slurry film thickness measuring unit 430 may include a semiconductor wafer carrier 210, configured to hold and move the semiconductor wafer 200. An upper column 241 preferably transmits a downward pressure and a rotational motion to the semiconductor wafer carrier 210. And a suspension spring 242 preferably buffers the upper column 241 and the semiconductor wafer carrier 210.

In addition, the slurry film thickness measuring unit 430 preferably includes a sensor 250 for measuring the thickness change of the slurry film formed between the semiconductor wafer 200 and the polishing pad 100. The sensor 250 can be a non-contact type displacement sensor configured to measure a relative displacement of the semiconductor wafer 200 with respect to the polishing pad 100 due to the thickness change of the slurry film. The sensor can measure, for instance, the distance between the upper column 241 and the semiconductor wafer carrier 210. The sensor 250 may, for example, measure the distance between the upper frame 241 and the semiconductor wafer carrier 210 using light, laser, ultrasonic, or electromagnetic radiation. The sensor 250 may include an emitter and a receiver of light, laser, ultrasonic, or electromagnetic radiation. The sensor 250 may or may not be mounted in the upper frame 241.

Figure 9:
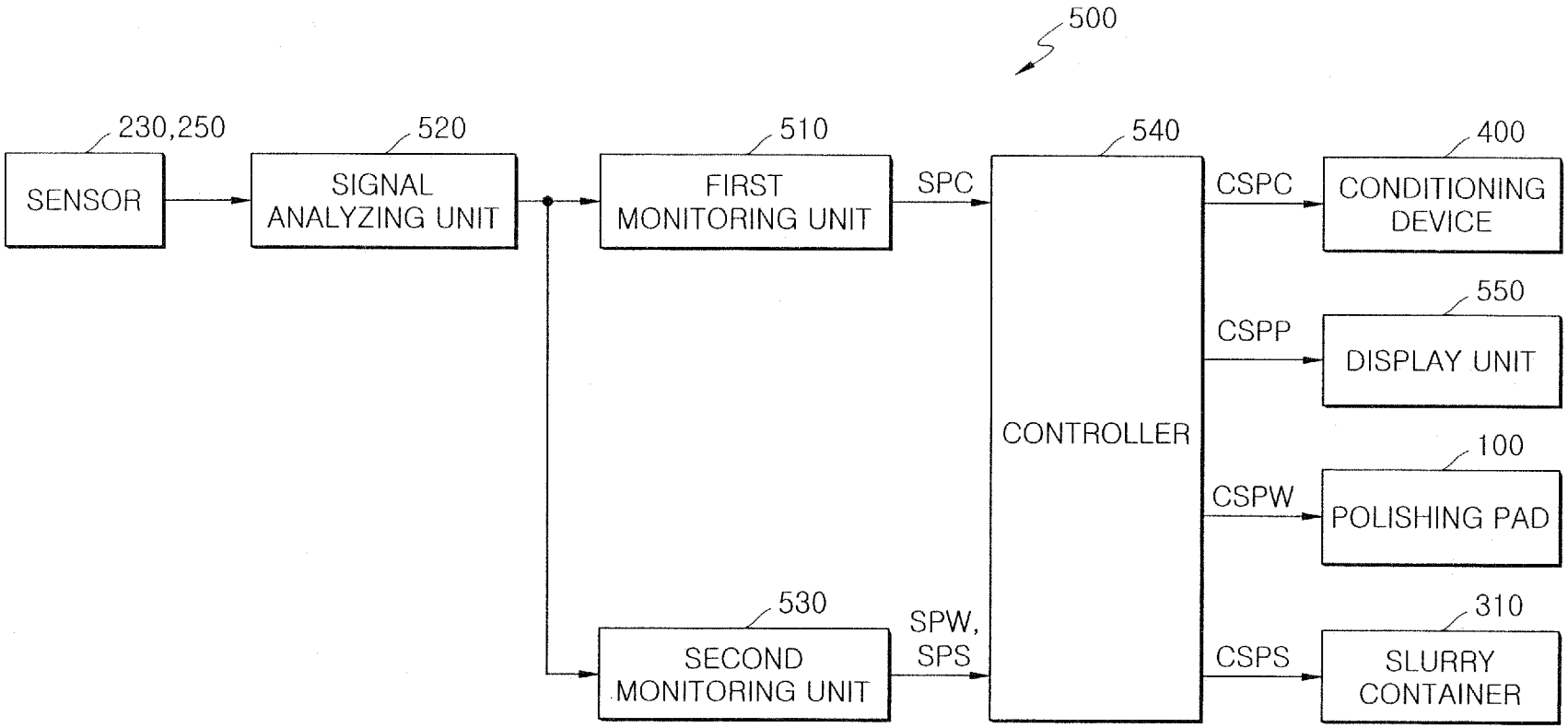
FIG. 9 is a schematic block diagram of a control unit for a polisher, according to a further embodiment of the present invention.

Referring back to FIG. 1, the polisher 10 further preferably includes a control unit 500 which receives data related to the thickness chance of the slurry film from the sensor 230 or 250 of the slurry film thickness measuring unit 430. The control unit 500 then preferably controls the conditioning device 400 and the slurry film thickness measuring unit 430. FIG. 9 is a schematic block diagram of the control unit 500. Referring also to FIG. 9, the control unit 500 preferably includes a signal analyzing unit 510, a first monitoring unit 520, a second monitoring unit 530, a controller 540, and a display unit 550.

The signal analyzing unit 510 preferably receives output signals from the sensor 230 or 250, calculates the relative displacement of the semiconductor wafer 200 with respect to the polishing pad 100 and provides a displacement value to the first and second monitoring units 520 and 530. The first monitoring unit 520 preferably receives data regarding the relative displacement of the semiconductor wafer with respect to the polishing pad 100 from the signal analyzing unit 510 and monitors the thickness change of the slurry film formed between the polishing pad 100 and the semiconductor wafer 200. According to the monitoring results obtained by the first monitoring unit 520, when the thickness of the slurry film increases due to the decrease of the surface roughness of the polishing pad 100, the first monitoring unit 520 preferably generates and transmits a control signal "SPC" the second monitoring unit 530.

The second monitoring unit 530 also preferably receives data relating to the relative displacement of the semiconductor wafer 200 with respect to the polishing pad 100 from the signal analyzing unit 510 and thereby monitors the thickness change of the slurry film formed between the polishing pad 100 and the semiconductor wafer 200. According to the monitoring 20 results obtained by the second monitoring unit 530, when the thickness of the slurry film increases due to the decrease of the depths "d1" of the grooves 21 caused by the abrasion of the polishing pad 100, the controller 540 preferably generates and transmits a control signal "SPW" or "SPS" to the controller 540.

Upon receiving the control signal "SPC" from the first monitoring unit 520, the controller 25 540 preferably generates and transmits a control signal "CSPC" to the conditioning device 400 to polish the surface of the polishing pad 100 to obtain an appropriate surface roughness. In addition, upon receiving the control signal "SPW" from the second monitoring unit 530, the controller 540 preferably generates and transmits a control signal "CSPW" to the polishing pad 100 to stop the polishing operation and a control signal "CSPP" to the display unit 550 for displaying a message indicating the replacement time of the polishing pad 100. The display unit 550 receives the control signal "CSPP" from the controller 540 and informs a user that the polishing pad 100 should be replaced. The display unit 550 preferably informs the user through a visible warning and/or an audible alarm. In addition, when the controller 540 receives the control signal "SPS" from the second monitoring unit 530, it preferably decreases the amount of the slurry 300 supplied from the slurry container 310 to the surface of the polishing pad 100.

Figure 10:
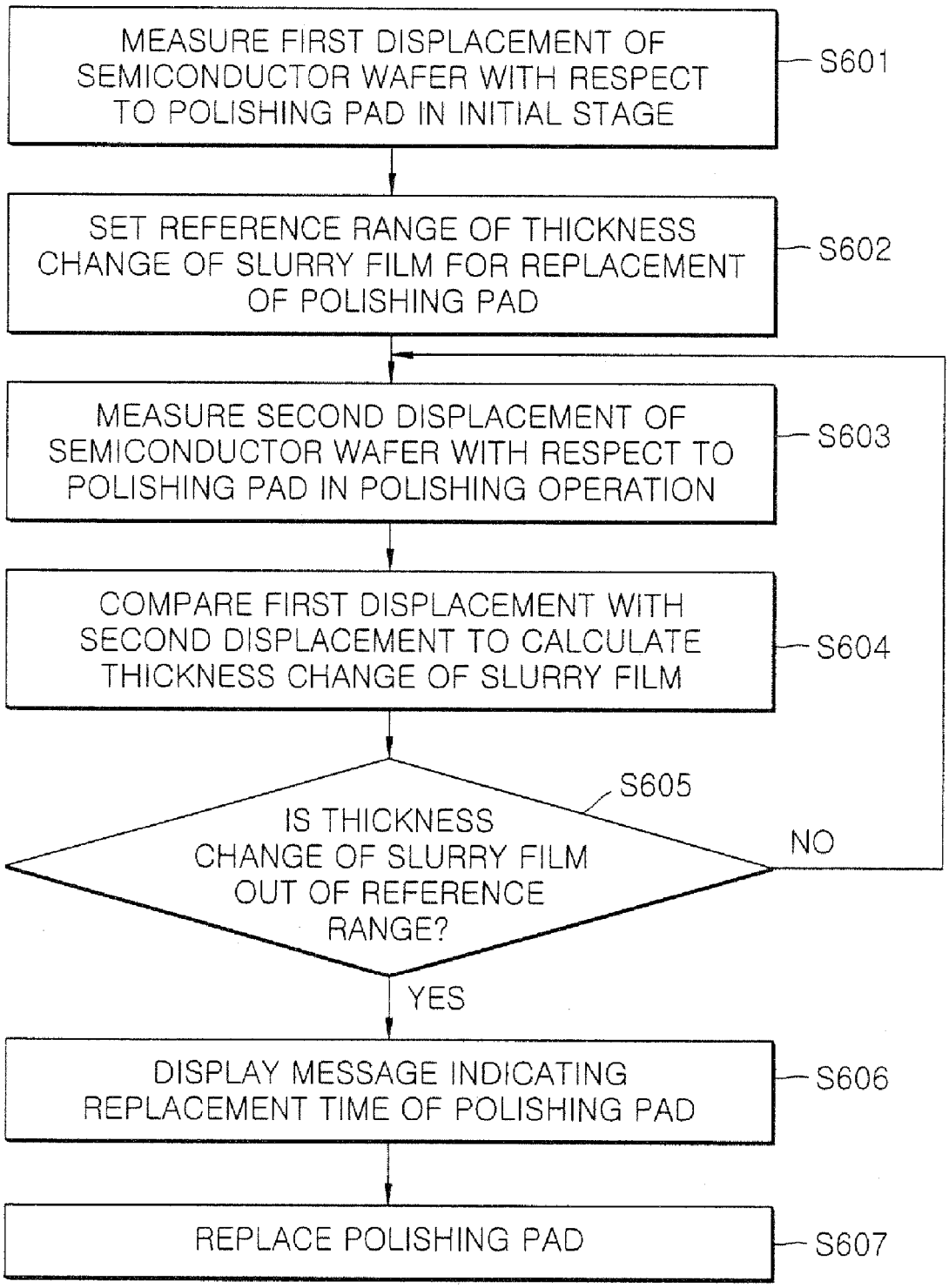
FIG. 10 is a flow chart illustrating a method of measuring an abrasion amount of a polishing pad using a thickness change of a slurry film, according to another embodiment of the present invention.

FIG. 10 is a flow chart illustrating a method of using a thickness change of a slurry film to measure an abrasion amount of the polishing pad 100 installed in the polisher 10, according to another embodiment of the present invention. Referring to FIGS. 7, 8 and 10, in operation S601, a first displacement of the semiconductor wafer 200 with respect to the polishing pad 100 is measured using the sensor 230 or 250 during an initial stage.

Referring additionally to FIG. 1, the CMP process preferably includes two operations: a ramp-up operation and a polishing operation. In the ramp-up operation, the semiconductor wafer 200 is pressed with a low pressure and rotated at a low relative speed with respect to the polishing pad 100 for several seconds. In the polishing operation, the semiconductor wafer 200 is pressed, applying a pressure greater than a predetermined value, and rotated at a high relative speed with respect to the polishing pad 100.

During the initial stage, the semiconductor wafer is not rotated, or the semiconductor wafer is rotated at low speed in a ramp-up operation, while the surface of the polishing pad 100 contacts the surface of the semiconductor wafer 200 and the slurry film is formed therebetween. With a low relative speed, the thickness of the slurry film does not change. The appropriate low relative speed, however, varies with the types and properties of the slurry 300. Referring to FIG. 4, for example, when the slurry 300 is ceria, the thickness of the slurry film does not significantly change when the relative speed is about 0.37 m/s. Since the relative speed between the polishing pad 100 and the semiconductor wafer 200 depends on the types and properties of the slurry 300 and the interfacial characteristics of the polishing pad 100 and the semiconductor wafer 200, the relative speed in an initial stage is preferably variably controlled.

The first displacement of the semiconductor wafer 200 with respect to the polishing pad 100 in the initial stage is preferably obtained by measuring a displacement in a direction substantially perpendicular to the surfaces of the polishing pad 100 and the semiconductor wafer 200. Referring again to FIG. 7, the displacement of the upper column 222 with respect to the upper frame 223 is preferably measured in that embodiment using the sensor 230 when the surface of the semiconductor wafer 200, supported by the semiconductor wafer carrier 210, contacts the surface of the polishing pad 100 and the slurry film is formed therebetween. The displacement is a distance between the upper frame 223 and the upper column 222 and corresponds to the thickness of the slurry film formed between the semiconductor wafer 200 and the polishing pad 100.

Referring back to FIG. 8, the displacement between the semiconductor wafer carrier 210 and the upper column 241 in the initial stage is preferably measured in that embodiment using the sensor 250. The displacement is a distance between the upper column 241 and the semiconductor wafer carrier 210 in a direction substantially perpendicular to the contact surface of the semiconductor wafer 200 and the polishing pad 100. The displacement again corresponds to the thickness of the slurry film formed between the semiconductor wafer 200 and the polishing pad 100.

Referring additionally to FIG. 9, an output signal generated from the sensor 230 or 250 of the slurry film thickness measuring unit 430 is transmitted to the signal analyzing unit 510 of the control unit 500. The signal analyzing unit 510 analyzes the output signal from the sensor 230 or 250, calculates the first displacement of the semiconductor wafer 200 with respect to the polishing pad 100 in the initial stage, and transmits the calculation results to the second monitoring unit 530. Referring again to FIG. 10, in operation S602, the second monitoring unit 530 sets a reference range of the thickness change of the slurry film to determine the replacement time of the polishing pad 100. The operation of measuring the first displacement of the semiconductor wafer 200 during the initial stage using the sensor 230 or 250 and the operation of setting the reference range of the thickness change of the slurry film may be performed in reverse order.

After setting the reference range, a polishing operation can then be performed. In the polishing operation, the semiconductor wafer 200 and the polishing pad 100 are preferably rotated relative to each other at high speed while the surface of the semiconductor wafer 200 contacts the surface of the polishing pad 100 and the slurry film is formed therebetween. A second displacement of the semiconductor wafer 200 with respect to the polishing pad 100 is preferably measured during the polishing operation using the sensor 230 or 250, in operation S603. The second displacement of the semiconductor wafer 200 preferably corresponds to the thickness of the slurry film formed between the semiconductor wafer 200 and the polishing pad 100 during the polishing operation, and the difference between the first displacement and the second displacement preferably represents a thickness change of the slurry film.

Referring back to FIG. 7, the thickness change of the slurry film in the polishing operation corresponds to the differential displacement of the upper column 222 with respect to the upper frame 223 in the direction substantially perpendicular to the contact surface between the polishing pad 100 and the semiconductor wafer 200. During the polishing operation, the depth "d1" of the grooves 21 of the polishing pad 100 decreases, and thus the thickness "T" of the slurry film increases, thereby changing the distance between the upper column 222 and the upper frame 223. Referring again to FIG. 8, the thickness change of the slurry film corresponds to a change in the distance between the upper column 241 and the semiconductor wafer carrier 210. Accordingly, the thickness of the slurry film formed between the semiconductor wafer 200 and the polishing pad 100 changes due to the decrease in the depth "d1" of the grooves 21 resulting from the abrasion of the polishing pad 100. The thickness change of the slurry film therefore corresponds to the differential displacements between the upper column 241 and the semiconductor wafer carrier 210.

Referring again to FIGS. 1, 9 and 10, the first displacement is preferably compared with the second displacement to calculate or otherwise determine the thickness change of the slurry film, in operation S604. In operation S605, the calculated thickness change of the slurry film is then compared to a reference range to determine whether it is out of the reference range. When the calculated thickness change of the slurry film is outside the reference range, the second monitoring unit 530 generates and transmits a control signal "SPW" to the controller 540. Accordingly, the controller 540 preferably generates and transmits a control signal "CSPP" to the display unit 550 to cause it to display a message indicating that it is time for replacement of the polishing pad 100. Also, the controller 540 preferably generates and transmits a control signal "SCPW" to the polishing pad 100 to stop the polishing operation. The display unit 550 preferably informs a user that the polishing pad 100 should be replaced using a visual warning display and/or an audible alarm, in operation S606. The user then preferably stops the polishing operation and replaces the polishing pad 100, in operation S607.

When the calculated thickness change of the slurry film is within the reference range, the operation S603 is performed again to measure the thickness change of the slurry film formed between the polishing pad 100 and the semiconductor wafer 200. According to various principles of the present invention, the operation of measuring the abrasion amount of the polishing pad 100 using the thickness change of the slurry film can be performed in each CMP process for each semiconductor wafer. The initial thickness of the slurry film is preferably measured during the ramp-up operation, the thickness change of the slurry film is then preferably measured in the polishing operation, and the replacement time of the polishing pad 100 can then be obtained by using the thickness change of the slurry film to determine the abrasion amount of the polishing pad 100.

Figure 11:
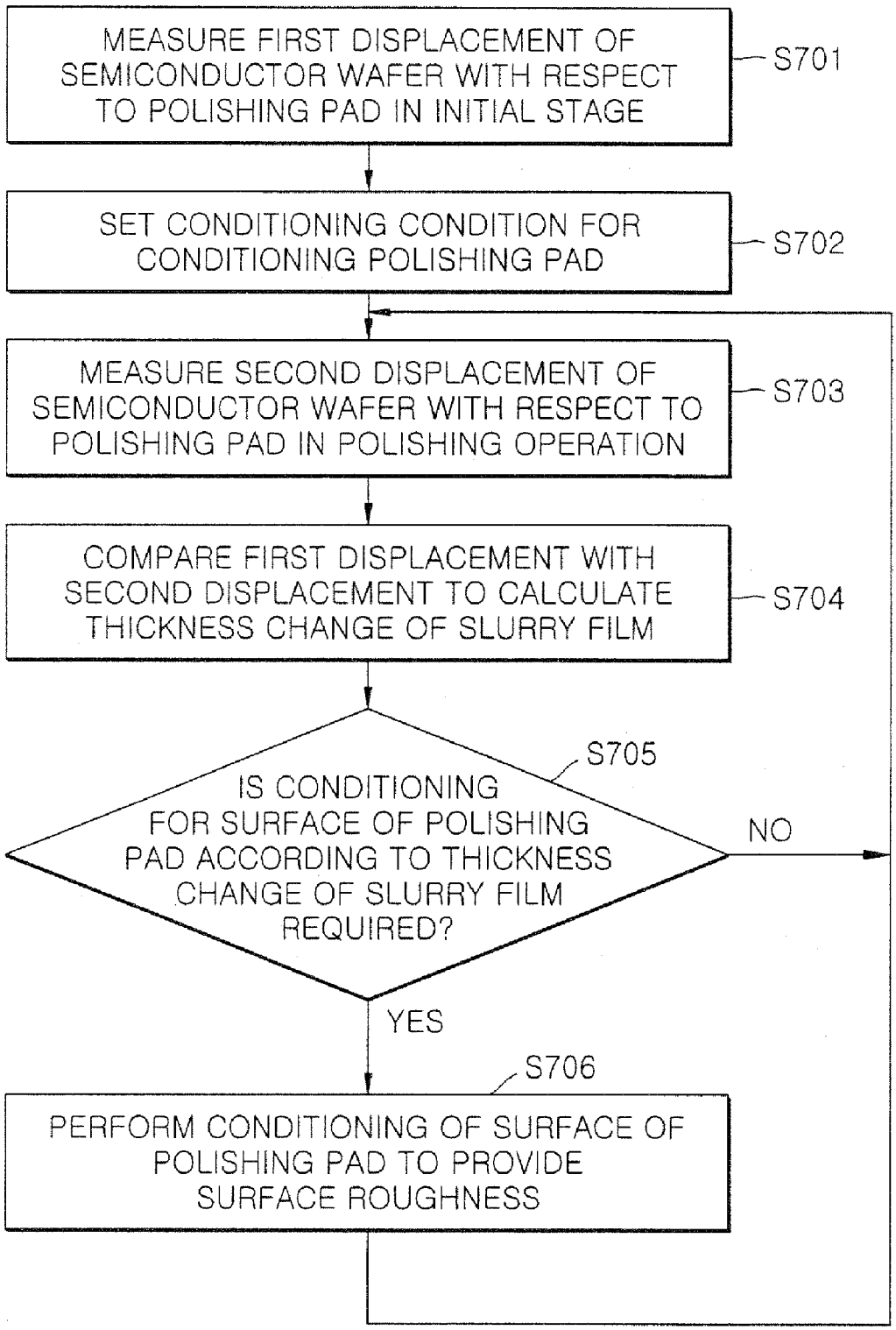
FIG. 11 is a flow chart illustrating a method of using a thickness change of a slurry film to determine when to perform a conditioning operation of a polishing pad according to yet another embodiment of the present invention.

FIG. 11 is a flow chart illustrating a method of using the thickness change of a slurry film to measure a friction force of a polishing pad 100 installed in the polisher 10 of FIG. 1, according to another embodiment of the present invention. Referring to FIG. 11, in operation S701, a first displacement of the semiconductor wafer 200 with respect to the polishing pad 100 in an initial stage is measured. The first displacement is preferably measured in a direction substantially perpendicular to the contact surface of the polishing pad 100 and the semiconductor wafer 200 using the sensor 230 of FIG. 7 or the sensor 250 of FIG. 8. The first displacement can then be analyzed in the signal analyzing unit 510 of FIG. 9, and then, transmitted to the first monitoring unit 520. The first monitoring unit 520 preferably sets a conditioning condition of the polishing pad 100 to provide a uniform surface roughness to the polishing pad 100, in operation S702. The operations of measuring the first displacement using the sensor 230 or 250 and setting the conditioning conditions of the polishing pad 100 may be performed in reverse order.

Next, a polishing operation is preferably performed. In the polishing operation, the semiconductor wafer 200 and the polishing pad 100 are rotated with respect to each other at high speed while the surface of the semiconductor wafer 200 contacts the surface of the polishing pad 100 and the slurry film is formed therebetween. A second displacement of the semiconductor wafer 200 with respect to the polishing pad 100 is measured during the polishing operation using the sensor 230 or 250, in operation S703. The second displacement is analyzed in the signal analyzing unit 510, and then, transmitted to the first monitoring unit 520. In operation S704, the first monitoring unit 520 compares the first displacement with the second displacement to determine the thickness change of the slurry film. The first monitoring unit 520 then, in operation S705, determines whether or not conditioning of the surface of the polishing pad 100 is required based on the calculated thickness change of the slurry film.

When conditioning of the polishing pad 100 is required, i.e., when the calculated thickness change of the slurry film fails the conditioning condition (e.g., depending on the embodiment, either by satisfying or by not satisfying the conditioning condition), the control signal "SPC" is generated to initiate conditioning of the polishing pad 100. Accordingly, the controller 540 receives the control signal "SPC" generated from the first monitoring unit 520 and generates a control signal "CSPC" to control the conditioning device 400. Then, in response to the control signal "CSPC", the conditioning device 400 polishes the surface of the polishing pad 100 to have a predetermined surface roughness, in operation S706. At this time, the amount of slurry supplied onto the polishing pad 100 may be increased or decreased. Meanwhile, when conditioning of the polishing pad 100 is not required, or after the conditioning operation in operation S706 has been performed, the operation S703 is preferably performed again to measure the thickness of the slurry film.

When the surface roughness of the polishing pad 100 decreases, the friction force thereof decreases, and, thus the force for removing the surface film of the semiconductor wafer 200 decreases too. In the present invention, the thickness change of the slurry film is preferably measured during the CMP process and the conditioning operation of the polishing pad is performed when determined by the measured thickness change. The conditioning time can therefore be minimized, and the start and the end of the conditioning operation can be optimized. In the current embodiment, when the conditioning condition is set in the ramp-up operation, it is preferably not changed until the polishing operation is finished. After the conditioning operation is performed, however, the operation S702 is preferably performed again, if necessary, in order to stop the conditioning operation depending on the friction state of the polishing pad, or to change the conditioning condition for a subsequent polishing operation. The rotation speed of the conditioning head and the force applied to the conditioning head are preferably real time-controlled, thereby minimizing the abrasion amount or wear of the polishing pad and optimizing the conditioning operation.

Figure 12:
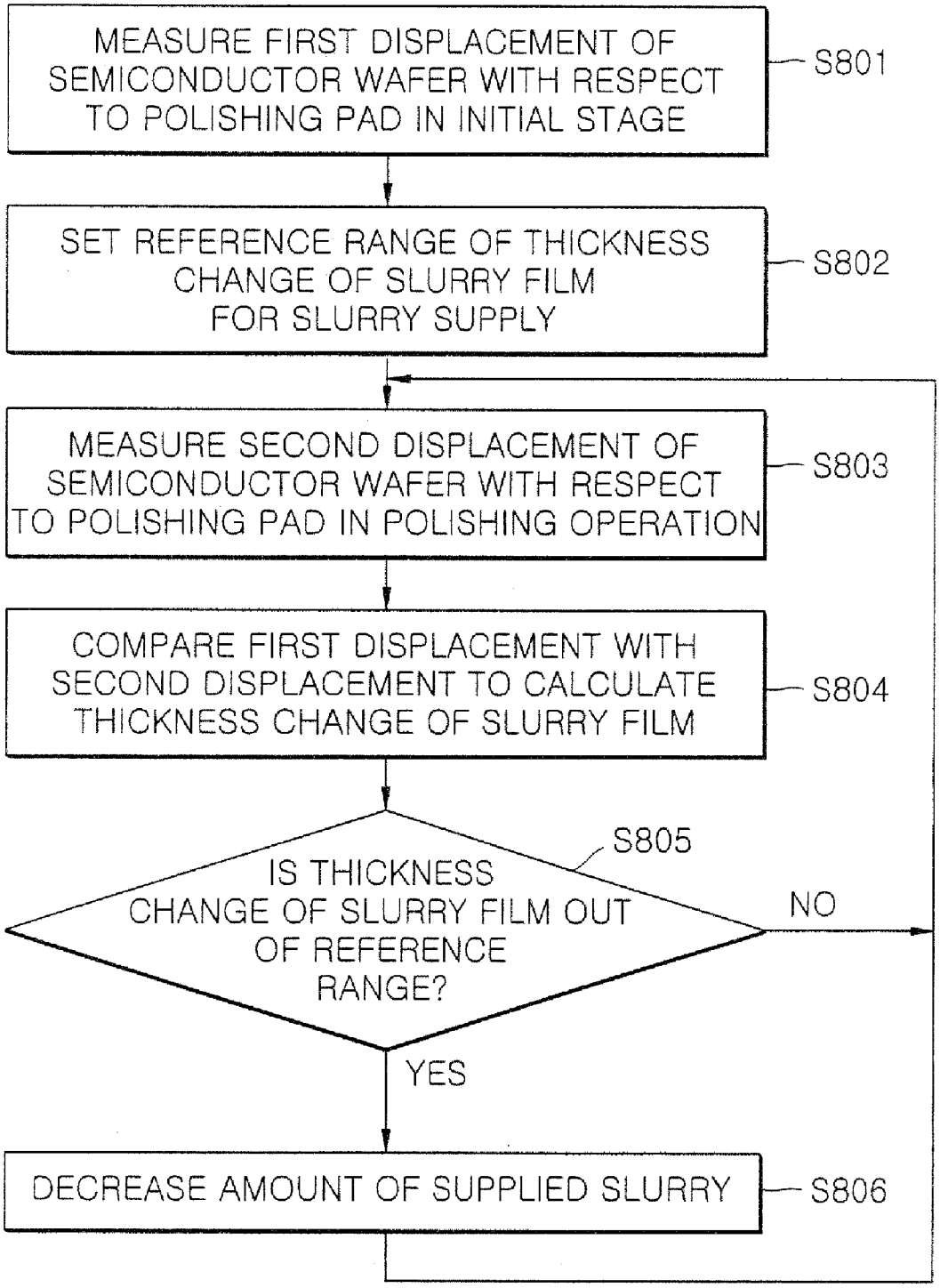
FIG. 12 is a flow chart illustrating a method of using a thickness change of a slurry film to control an amount of slurry supplied onto a polishing pad installed in a polisher according to another embodiment of the present invention.

FIG. 12 is a flow chart illustrating a method of using the thickness change of a slurry film to control an amount of slurry 300 supplied onto the polishing pad 100 installed in the polisher 10 of FIG. 1, according to another embodiment of the present invention. In FIG. 12, the thickness change of the slurry film, which corresponds to the abrasion state of the polishing pad 100, is measured and the amount of slurry 300 supplied from slurry container 310 onto the surface of the polishing pad 100 is preferably controlled based on the measured thickness change. Referring to FIGS. 1, 7, 8, 9 and 12, in operation S801, a first displacement of the semiconductor wafer 200 with respect to the polishing pad 100 is measured during an initial stage using the sensor 230 or 250. An output signal generated from the sensor 230 or 250 of the slurry film thickness measuring unit 430 is transmitted to the signal analyzing unit 510 of the control unit 500. The signal analyzing unit 510 analyzes the output signal from the sensor 230 or 250 and determines the first displacement of the semiconductor wafer 200 with respect to the polishing pad 100, which corresponds to the thickness of the slurry film in the initial stage. The displacement results are then transmitted to the second monitoring unit 530. The second monitoring unit 530 sets a reference range for the thickness change of the slurry film, in operation S802. The reference range of the thickness change of the slurry film can then be used to control the amount of the slurry 300 supplied from the slurry container 310 to the surface of the polishing pad 100. The operation of measuring the first displacement of the semiconductor wafer 200 in the initial stage and the operation of setting the reference range of the thickness change of the slurry film may be performed in reverse order.

Next, a polishing operation is preferably performed. In the polishing operation, the semiconductor wafer 200 and the polishing pad 100 are rotated relative to each other at high speed while the surface of the semiconductor wafer 200 contacts the surface of the polishing pad 100 and the slurry film is formed therebetween. In operation S803, a second displacement of the semiconductor wafer 200 with respect to the polishing pad 100 is measured during the polishing operation using the sensor 230 or 250. The first displacement is then compared with the second displacement to calculate the thickness change of the slurry film in operation S804. In operation S805, the thickness change is evaluated with respect to the reference range to determine whether or not the calculated thickness change of the slurry film is out of the reference range.

When the calculated thickness change of the slurry film is out of the reference range, the second monitoring unit 530 generates and transmits a control signal "SPS" to the controller 540. In response, the controller 540 generates and transmits a control signal "SCPS" to the slurry container 310 to reduce the supply amount of the slurry 300. The amount of the slurry 300 supplied from the slurry container 310 to the surface of the polishing pad 100 is preferably adjusted accordingly. When the calculated thickness change of the slurry film is within the reference range, the amount of the slurry 300 supplied from the slurry container 310 to the surface of the polishing pad 100 is maintained, and the operation S803 is performed again to measure the thickness change of the slurry film during the polishing operation.

In the current embodiment, the thickness change of the slurry film is measured and the amount of the slurry 300 supplied onto the polishing pad 100 can be adjusted if the amount of the slurry 300 formed between the polishing pad 100 and the semiconductor wafer 200 is excessive or insufficient. The amount of the slurry 300 used during the CMP process can thereby be minimized or optimized. Although in the current embodiment, the amount of slurry 300 is preferably decreased in response to a decreased thickness change of the slurry film, the reference range of the thickness change of the slurry film may be variously set, and thus, the amount of slurry 300 can be increased or decreased depending on the thickness change of the slurry film.

Figure 13:
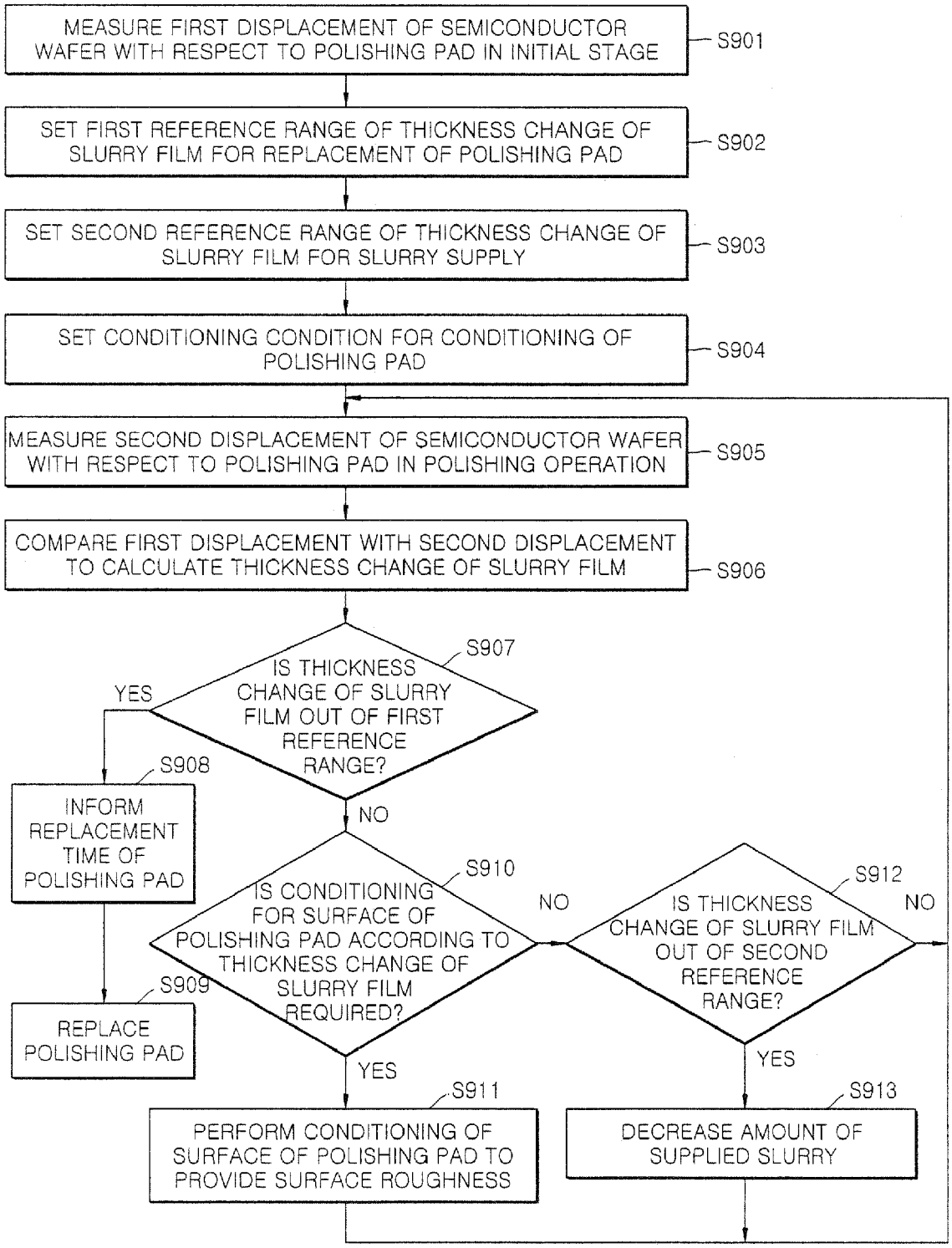
FIG. 13 is a flow chart illustrating a CMP method that uses a thickness change of a slurry film, according to another embodiment of the present invention.

FIG. 13 is a flow chart illustrating a CMP method that uses a thickness change of a slurry film to control operations of the CMP process, according to another embodiment of the present invention. Referring to FIGS. 1, 7, 8, 9 and 13, a first displacement of the semiconductor wafer 200 with respect to the polishing pad 100 is measured in an initial stage using the sensor 230 or 250. The signal analyzing unit 510 receives an output signal from the sensor 230 or 250 and calculates the first displacement of the semiconductor wafer 200 during the initial stage, in operation S901. The second monitoring unit 530 preferably sets a first reference range of the thickness change of the slurry film for replacing the polishing pad 100, in operation S902. A second reference range of the thickness change of the slurry film for controlling the amount of the slurry 300 supplied onto the polishing pad 100 is preferably set in operation S903. The first monitoring unit 520 preferably sets a conditioning condition in operation S904.

A polishing operation can then be performed. In the polishing operation, the semiconductor wafer 200 and the polishing pad 100 are rotated at high speed relative to each other while the surface of the semiconductor wafer 200 contacts the surface of the polishing pad 100 and the slurry film is formed therebetween. In operation S905, a second displacement of the semiconductor wafer 200 with respect to the polishing pad 100 is measured during the polishing operation using the sensor 230 or 250. The second displacement therefore corresponds to the thickness of the slurry film during the polishing operation. The first displacement is then compared with the second displacement to calculate the thickness change of the slurry film, in operation S906. In operation S907, the thickness change is compared to a reference range to determine whether or not the calculated thickness change of the slurry film is out of the first reference range. When the calculated thickness change of the slurry film is outside the first reference range, the second monitoring unit 530 preferably generates and transmits a control signal "SPW" to the controller 540. In response, the controller 540 preferably generates and transmits a control signal "CSPP" to the display unit 550 to display a message indicating the replacement time of the polishing pad 100. Also, the controller 540 preferably generates and transmits a control signal "SCPW" to the polishing pad 100 for stopping the polishing operation. The display unit 550 preferably informs a user that the polishing pad 100 should be replaced using a warning display and/or an alarm in operation S908. The user can then stop the polishing operation and replace the polishing pad 100, in operation S909.

In operation S910, when the calculated thickness change of the slurry film is within the first reference range, the thickness change of the slurry film is used to determine whether or not conditioning of the surface of the polishing pad 100 is required. When conditioning the surface of the polishing pad 100 is required, the first monitoring unit 520 preferably generates and transmits the control signal "SPC" to the controller 540. The controller 540 then preferably generates and transmits a control signal "CSPC" to the conditioning device 400. The surface of the polishing pad 100 can then be polished to have a predetermined surface roughness in response to the control signal "CSPC", in operation S911.

When conditioning of the surface of the polishing pad 100 is not required, the measured thickness change of the slurry film is preferably compared to the second reference range to determine whether or not the thickness change is within the second reference range, in operation S912. When the measured thickness change of the slurry film is outside the second reference range, the amount of the slurry 300 supplied from the slurry container 310 onto the surface of the polishing pad 100 is preferably decreased, in operation S913. When the measured thickness change of the slurry film is within the second reference range, the operation S905 is performed again to measure the thickness of the slurry film formed between the polishing pad 100 and the semiconductor wafer 200.

Although in various embodiments of the present invention the operations are performed in a certain order depending on the abrasion state of the polishing pad, the conditioning state of the polishing pad, and the amount of slurry, the principles of present invention are not limited to a particular order and various steps and processes can be performed in different orders or omitted altogether. In addition, the method of measuring the abrasion amount of the polishing pad, the method of measuring the friction force of the polishing pad, and the method of controlling the supply amount of slurry using the thickness change of the slurry film can be performed separately or simultaneously. In addition, any two of the three methods can be arbitrarily chosen and combined to increase the performance thereof.

In summary, according to principles of the present invention, as described above, the abrasion state of the polishing pad can be monitored using the thickness change of the slurry film in the CMP process, and thus, the replacement time of the polishing pad can be more precisely obtained, thereby enhancing the stability, effectiveness, and economy of the polishing operation.

In addition, according to principles of the present invention, the conditioning operation can be controlled by monitoring the thickness change of the slurry film corresponding to the surface roughness of the polishing pad, thereby optimizing the conditioning operation and reducing the abrasion amount of the polishing pad. In addition, the thickness change of the slurry film can be measured to control the amount of slurry between the polishing pad and the semiconductor wafer, thereby minimizing the amount of slurry needed to perform the CMP process.

While the present invention has been particularly shown and described with reference to certain exemplary embodiments thereof, it will be understood by those of ordinary skill in the art that various changes in form and details may be made therein without departing from the spirit and scope of the present invention as defined by the following claims.

What is claimed is:

1. A method of measuring an abrasion amount of a polishing pad, the method comprising:

measuring a first displacement corresponding to a thickness of a slurry film formed between a semiconductor wafer and a polishing pad during an initial stage;

setting a reference range of a thickness change of the slurry film to determine a time for replacement of the polishing pad;

measuring a second displacement corresponding to a thickness of the slurry film formed between the semiconductor wafer and the polishing pad during the polishing operation;

comparing the first displacement with the second displacement to determine the thickness change of the slurry film; and identifying the time for replacement of the polishing pad when the thickness change of the slurry film is out of the reference range.

2. The method of claim 1, wherein the polishing pad and the semiconductor wafer move relative to each other, and wherein the thickness of the slurry film formed between the polishing pad and the semiconductor wafer is constant during the initial stage and changes during the polishing operation.

3. The method of claim 1, wherein the first displacement and the second displacement of the semiconductor wafer are measured in a contact manner.

4. A method of adjusting an amount of slurry in a chemical mechanical polishing (CMP) process, the method comprising:

supplying an amount of slurry to a polishing pad;

measuring a first displacement corresponding to a thickness of a slurry film formed between a semiconductor wafer and the polishing pad during an initial stage;

setting a reference range of a thickness change of the slurry film to be used to control the amount of slurry supplied to the polishing pad;

measuring a second displacement corresponding to a thickness of the slurry film formed between the semiconductor wafer and the polishing pad during the polishing operation;

comparing the first displacement with the second displacement to determine the thickness change of the slurry film; and adjusting the amount of the slurry supplied to the polishing pad when the thickness change of the slurry film is outside the reference range.

5. The method of claim 4, wherein the polishing pad and the semiconductor wafer move relative to each other, and wherein the thickness of the slurry film formed between the polishing pad and the semiconductor wafer is constant during the initial stage and changes during the polishing operation.

6. The method of claim 4, wherein the first displacement and the second displacement are measured in a non-contact manner.

7. A method of measuring a friction force of a polishing pad, the method comprising:

measuring a first displacement corresponding to a thickness of a slurry film formed between a semiconductor wafer and a polishing pad during the initial stage;

setting a conditioning condition of the polishing pad;

measuring a second displacement corresponding to a thickness of a slurry film formed between the semiconductor wafer and the polishing pad during the polishing operation;

comparing the first displacement with the second displacement to determine a thickness change of the slurry film; and conditioning a surface of the polishing pad when the thickness change of the slurry film fails the conditioning condition.

8. The method of claim 7, further comprising:

changing the conditioning condition based on the thickness change of the slurry film.

9. The method of claim 7 further comprising:

adjusting an amount of slurry supplied to the polishing pad when the thickness change of the slurry film does not satisfy the conditioning condition.

10. The method of claim 7, wherein the polishing pad and the semiconductor wafer move relative to each other, and wherein the thickness of the slurry film formed between the polishing pad and the semiconductor wafer is constant during the initial stage and changes during the polishing operation.

11. The method of claim 7, wherein the first displacement and the second displacement of the semiconductor wafer are measured in a contact manner.

12. A chemical mechanical polishing (CMP) method comprising:

supplying an amount of slurry to a polishing pad being used in a CMP process;

measuring a first displacement of a semiconductor wafer with respect to the polishing pad, the first displacement corresponding to a thickness of a slurry film formed between the semiconductor wafer and the polishing pad during an initial stage;

setting a first reference range for a thickness change of the slurry film to determine a time for replacement of the polishing pad;

setting a second reference range for the thickness change of the slurry film to control the amount of slurry supplied to the polishing pad;

setting a conditioning condition of the polishing pad;

measuring a second displacement of the semiconductor wafer with respect to the polishing pad, the second displacement corresponding to a thickness of a slurry film formed between the semiconductor wafer and the polishing pad during a polishing operation;

comparing the first displacement with the second displacement to determine a thickness change of the slurry film;

indicating the time for replacement of the polishing pad when the thickness change of the slurry film is out of the first reference range;

conditioning a surface of the polishing pad when conditioning is desirable based on the conditioning condition; and adjusting the amount of slurry supplied to the polishing pad when the thickness change of the slurry film is out of the second reference range.

13. The CMP method of claim 12, wherein the polishing pad and the semiconductor wafer move relative to each other, and wherein the thickness of the slurry film formed between the polishing pad and the semiconductor wafer is constant in the initial stage and changes in the polishing operation.

14. The CMP method of claim 12, wherein the first displacement and the second displacement are measured in a non-contact manner.

15. The CMP method of claim 12, further comprising:

changing the conditioning condition depending on the thickness change of the slurry film.

16. The CMP method of claim 14, wherein adjusting the amount of slurry comprises:

increasing the amount of slurry supplied onto the polishing pad when a thickness change of the slurry film does not satisfy the conditioning condition.

* * * * *

UNITED STATES PATENT AND TRADEMARK OFFICE

CERTIFICATE OF CORRECTION

PATENT NO. : 7,220,163 B2
APPLICATION NO. : 11/428813
DATED : May 22, 2007
INVENTOR(S) : Sung-Ho Shin It is certified that error appears in the above-identified patent and that said Letters Patent is hereby corrected as shown below:

Column 8, line 8, the word “chance” should read -- change --;
Column 8, line 39, the words “monitoring 20” should read -- monitoring --;
Column 8, line 46, the words “controller 25 540” should read -- controller 25 --.

Signed and Sealed this

Twelfth Day of August, 2008

JON W. DUDAS
*Director of the United States Patent and Trademark Office*